United States Patent [19]

Goldman

[11] 4,432,573

[45] Feb. 21, 1984

[54] LOCKING SYSTEM FOR SAFES

[76] Inventor: Ilan Goldman, 10 Bar-Eli St., Tel Aviv, Israel

[21] Appl. No.: 286,002

[22] Filed: Jul. 22, 1981

[30] Foreign Application Priority Data

Aug. 8, 1980 [IL] Israel ..... 60796

[51] Int. Cl.[3] ..... E05B 63/14; E05C 1/06; E05C 9/10; E05C 9/14

[52] U.S. Cl. ..... 292/37; 70/118; 70/418; 292/39; 292/150

[58] Field of Search ..... 70/118, 119, 120, 113, 70/418; 292/37, 39, 33, 34, 150, 159, 160

[56] References Cited

U.S. PATENT DOCUMENTS

| | | | |
|---|---|---|---|
| 512,022 | 1/1894 | Gower | 292/34 X |
| 564,388 | 7/1896 | Merritt | 292/37 X |
| 826,607 | 7/1906 | Price | 70/118 X |
| 1,600,982 | 9/1926 | Golloway et al. | 292/39 X |
| 2,486,460 | 11/1949 | Bonenberger | 292/39 X |
| 2,488,524 | 11/1949 | Castellano | 292/37 X |
| 2,918,883 | 12/1959 | Graber et al. | 292/39 X |
| 2,946,214 | 7/1960 | Gotay | 70/118 |
| 3,545,799 | 12/1970 | Gertsfeld | 70/120 X |

FOREIGN PATENT DOCUMENTS

| | | | |
|---|---|---|---|
| 238080 | 9/1911 | Fed. Rep. of Germany | 70/120 |
| 2810058 | 9/1978 | Fed. Rep. of Germany | 292/37 |
| 2845277 | 4/1980 | Fed. Rep. of Germany | 70/120 |
| 387398 | 7/1908 | France | 70/120 |
| 636744 | 1/1928 | France | 70/120 |

*Primary Examiner*—Robert L. Wolf
*Assistant Examiner*—Carl F. Pietruszka
*Attorney, Agent, or Firm*—Ostrolenk, Faber, Gerb & Soffen

[57] ABSTRACT

A locking system for safe doors of the type comprising a turnable handle or handwheel for operating one or more sets of bolts between a locked position, wherein the bolts project into the door rim, and an unlocked position, wherein the bolts are withdrawn from the door rim. The system is characterized by bolt-securing means in the form of locking pins adapted to be inserted, in the locked position of the bolt, into aligned bores formed through each bolt and through a wall of a fixed bolt housing block slidingly supporting the bolt during the displacement thereof between the locked and unlocked positions.

The pins are displaced into their locking or inserted position immediately after the locking of the bolts during a continuous rotation of the handle.

6 Claims, 3 Drawing Figures

LOCKING SYSTEM FOR SAFES

BACKGROUND OF THE INVENTION

The present invention relates to locking systems for doors, particularly to safe door multi-bolt systems wherein a number of bolt sets, normally three—for the upper, side and bottom of the door—are simultaneously operated to lock the safe. More specifically, the invention concerns means for securing the bolts in their locked position against forceful withdrawal thereof from outside the safe during an attempted burglary.

BRIEF SUMMARY OF THE INVENTION

According to a broad aspect of the invention there is provided a turnable handle or handwheel operated locking system for safe doors, comprising at least one set of bolts, each bolt being slidable within a fixed bolt housing block between locking and unlocking positions wherein the bolts project into, and are withdrawn from the door rim, respectively, characterized by bolt-securing means comprising, for each of said bolts, a locking pin extending normally to the bolt and being in axial alignment with an opening formed at a wall of the said block, a bore formed in the bolt parallel to the axial direction of said opening and said pin, so that in the projected position of the bolt the bore and said opening become aligned with respect to each other, and means for inserting the pin through said opening and into said bore for securing the bolt in the locking position.

BRIEF DESCRIPTION OF THE DRAWINGS

These and further details of construction of the present invention will become more clearly understood in the light of the ensuing description of a preferred embodiment of the invention, given by way of example only, with reference to the accompanying drawings, wherein.

DESCRIPTION OF A PREFERRED EMBODIMENT

Figure 1:
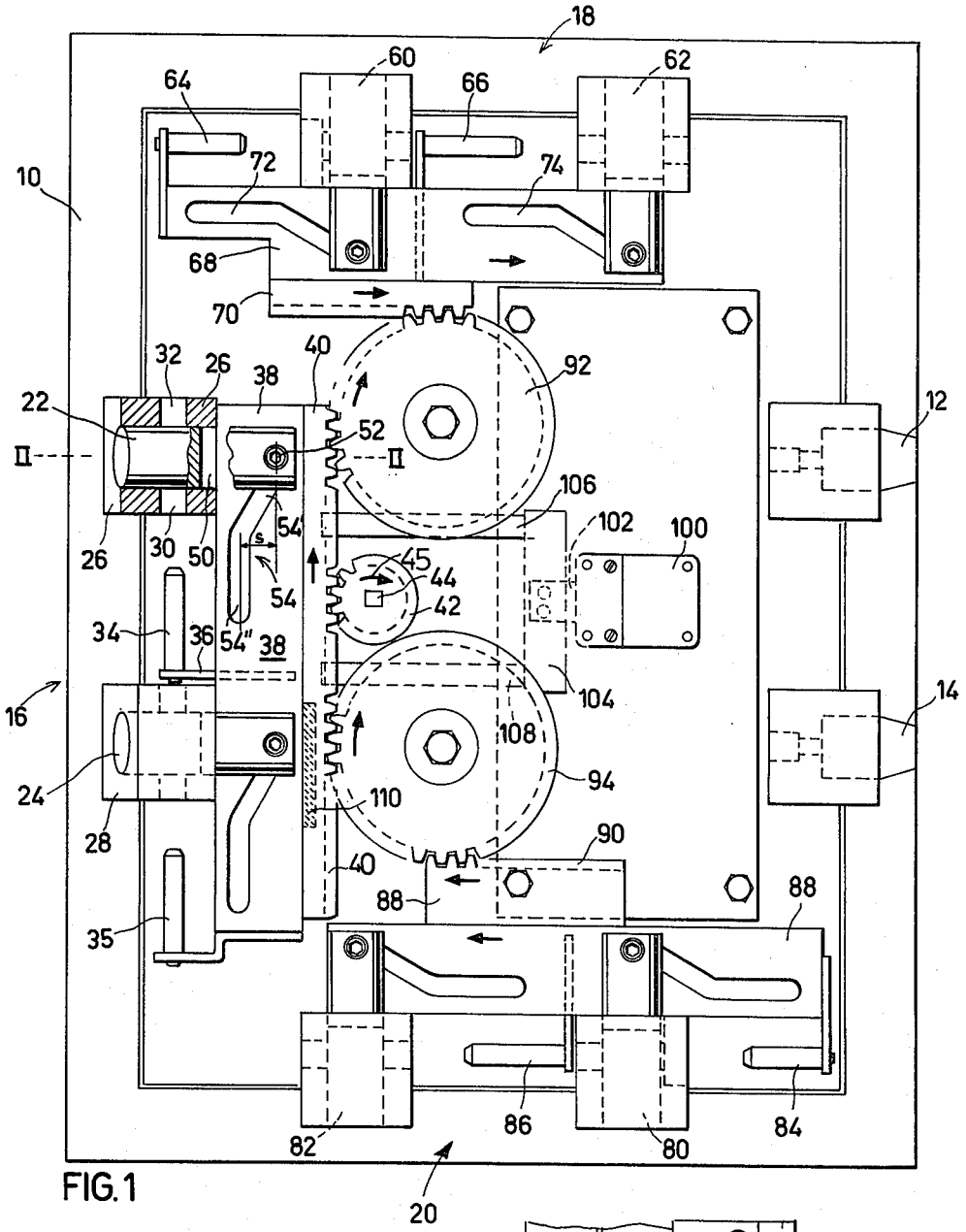
FIG. 1 is a plan view from the inside of a lefthand hinged safe door.

Door 10 shown in FIG. 1 is a lefthand-side hinged door comprising a pair of conventional fixed locking pins 12 and 14. There are further provided three sets of locking bolts and associated securing means according to the present invention, generally marked 16, 18 and 20. Bolt set 16 comprises a pair of reciprocable lock bolts 22 and 24 slidably supported within fixed blocks 26 and 28 welded to the door 10 (see FIG. 2). Reference shall be made now in detail to bolt 22 of set 16 and associated parts, it being understood that the construction and operation of the remaining bolts and bolt sets are very much the same.

Block 26 has openings 30 and 32 in register with respect to each other and directed transversely to the locking and unlocking direction of bolt 22. The common axis of openings 30 and 32 lies in the plane of, and intersects the axis of the bolt 22. There is further provided a securing pin 34 coaxially with openings 30 and 32, the pin 34 being mounted by a bracket 36 to a rck bar 38 of a toothed rack 40. Rack bar 38 is slidable parallel to the axis of openings 30 and 32. The gear teeth of the rack 40 mesh with a pinion 42 which is directly driven by the safe handle of handwheel (not shown) couple thereto by a square pin 44. The clockwise locking direction of the handle is denoted by the arrow 45.

Figure 2:
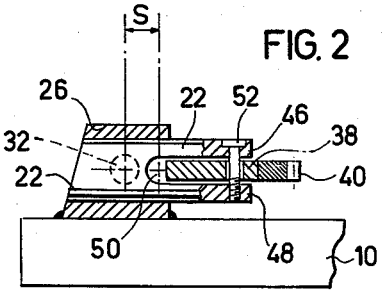
FIG. 2 is a cross-section taken along line II—II of FIG. 1.

As more clearly shown in FIG. 2, the rear portion of bolt 22 is bifurcated comprising an upper leg 46 and a lower leg 48 so that the bar 38 of the rack 40 is freely accommodated therebetween. It will further be noted that a throughgoing opening or bore 50 is formed in the bolt 22, parallel to and in the same plane as openings 30 and 32, defined by a further extension of the cut-away portion between legs 46 and 48. The distance between the axis of openings 30, 32 and the bore 50 is marked S.

Figure 3:
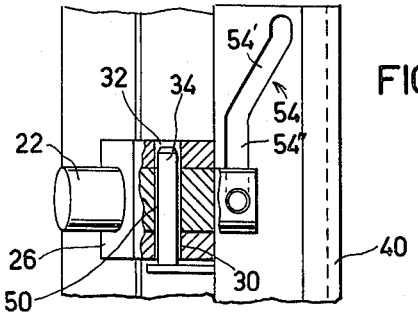
FIG. 3 shows one of the bolts and securing pins in their locking position.

A stud screw 52 serves to connect the legs 46 and 48 of the bolt 22 to the bar 38 in the following manner. As shown in FIGS. 1 and 3 there is provided a slot 54 comprising a first, inclined section 54' and a second section 54'' parallel to the axis of the securing pin 34 and the openings 30 and 32, the distance between the axis of section 54'' and the crest or end of the first section 54' is again equal to the distance S.

The constructional details of the second bolt 24 is the same as for bolt 22. This applies also to bolts 60 and 62 of the bolt set 18, namely it comprises securing pins 64 and 66, a slidable bar 68 with toothed rack 70, the bar 68 having therein formed guiding slots 72 and 74. The bottom set 20 again includes bolts 80 and 82, securing pins 84 and 86, bar 88 and rack 90. Racks 70 and 90 are coupled for the slidable movement thereof via gearwheels 92 and 94, respectively, which mesh with the teeth of rack 40, as shown.

The door 10 is optionally further provided with a key-operated or combination lock 100 having a projectable tongue or lock member 102 which operates, via a bracket 104, a pair of locking rods or bars 106 and 108, the arrangement being such that when the locking member 102 is projected from the lock 100, the bars 106 and 108 become located at the sides of a block 110 to interfere with the unlocking movement direction of the rack bar 38. Of course, the combination lock and locking member thereof may be associated with any other of the rack bars 68 or 88, at the option of the designer.

The operation of the system will now be described. First, let us assume that the handle 44 is rotated clockwise, namely in the locking direction of the system. Pinion 42, meshing with the teeth of rack 40 will cause the slotted rack bar 38 to move upwards thereby guiding the pin 52 along slot section 54' which causes the projection of the locking bolt 22. When guide pin 52 reaches the intersection between sections 54' and 54'' the bolt 22 would be fully projected and the securing pin 34 be about to enter the opening 30. When the bar 38 continues to move upwardly, the pin 34 will enter and pass through opening 30, bore 50 and the opening 32 of the other side of block 26, as shown in FIG. 3. Simultaneously, all other securing pins 35, 64, 66, 84 and 86 will become inserted through the walls of their respective blocks into the bolts 24, 60, 62, 80 and 82, thus securing the bolts against forceful withdrawal thereof. Lock 100 would then complete the locking operation by preventing the movement of bar 38, together with bars 68 and 88.

Those skilled in the art will readily appreciate that many variations based on the securing-pins concept may be applied without departing from the essential features of the invention as defined in the appended claims.

What is claimed is:

1. A turnable handle or handwheel operated locking system for safe doors, comprising at least one set of bolts, each bolt being slidable within a fixed bolt housing block between locking and unlocking positions wherein the bolts project into, and are withdrawn from the door rim, respectively, a locking pin for each of said bolts extending normal to the bolt and being in axial alignment with an opening formed at a wall of the said block, a bore formed in the block parallel to the axial direction of said opening, and said pin, the pin being slidably movable in said axial direction and being mounted onto a support member coupled, on the one hand, to the handle and, on the other hand, to the bolts of each bolt set for displacing the bolts into their projected and withdrawn positions, so that in the projected position of each bolt, its associated bore and opening become aligned with respect to each other and the pin becomes inserted through said opening and into said bore for securing the bolt in the locking position.

2. The system as claimed in claim 1 wherein said support member comprises a rack whose teeth are meshed with a pinion.

3. The system as claimed in claim 2 wherein the support member forms a flat bar provided with a slot having a first section extending at an angle with respect to the said axial direction and a second section extending parallel to the said direction, the bolts being coupled to the bar by a guiding pin moveable within the slot.

4. The system as claimed in claim 3 comprising three sets of bolts and securing means, for the upper, side and bottom of the door.

5. The system as claimed in claim 4 wherein the rack of one set is coupled to the racks of the other sets through gearwheels.

6. The system as claimed in claim 5 further including a key-operated or combination lock having a projectable locking member adapted to arrest the slidable movement of one of said racks.

* * * * *